US011247102B2

(12) United States Patent
Namba et al.

(10) Patent No.: US 11,247,102 B2
(45) Date of Patent: Feb. 15, 2022

(54) GOLF BALL

(71) Applicant: Bridgestone Sports Co., Ltd., Tokyo (JP)

(72) Inventors: Atsushi Namba, Saitamaken (JP); Yusuke Suzuki, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 17/097,051

(22) Filed: Nov. 13, 2020

(65) Prior Publication Data

US 2021/0187359 A1 Jun. 24, 2021

(30) Foreign Application Priority Data

Dec. 20, 2019 (JP) ..... JP2019-230379

(51) Int. Cl.
*A63B 37/06* (2006.01)
*A63B 37/00* (2006.01)

(52) U.S. Cl.
CPC ..... *A63B 37/0039* (2013.01); *A63B 37/0031* (2013.01); *A63B 37/0046* (2013.01); *A63B 37/0048* (2013.01); *A63B 37/0087* (2013.01)

(58) Field of Classification Search
CPC ..... A63B 37/0038; A63B 37/0048; A63B 37/0049
USPC ..... 473/373
See application file for complete search history.

(56) References Cited

U.S. PATENT DOCUMENTS

| | | | | |
|---|---|---|---|---|
| 5,977,264 | A | 11/1999 | Ichikawa et al. | |
| 5,994,472 | A | 11/1999 | Egashira et al. | |
| 6,130,294 | A * | 10/2000 | Ichikawa | A63B 37/0003 473/372 |
| 2008/0194359 | A1* | 8/2008 | Higuchi | A63B 37/0063 473/373 |
| 2018/0078826 | A1* | 3/2018 | Loper | A63B 37/0031 |

FOREIGN PATENT DOCUMENTS

| | | | |
|---|---|---|---|
| JP | 09-056849 | A | 3/1997 |
| JP | 10-127822 | A | 5/1998 |

* cited by examiner

*Primary Examiner* — Raeann Gorden
(74) *Attorney, Agent, or Firm* — Sughrue Mion, PLLC

(57) ABSTRACT

In a golf ball having a rubber core and an intermediate layer and outermost layer which encase the core, the intermediate layer is formed of a thermoplastic resin composition which has a flexural rigidity of 400 to 500 MPa and a melt flow rate of 15 g/10 min or less and includes 50 to 100 wt % of a magnesium salt of an ethylenically unsaturated carboxylic acid copolymer, the outermost layer is formed of a polyurethane resin composition having a Shore D material hardness of 55 or less, and the golf ball has a deflection within a given range. Compared with conventional golf balls containing the high-rigidity ionomer resins hitherto used as intermediate layer materials, this ball suppresses the spin rate on shots with a driver and long and middle irons, enabling an increased distance to be obtained, and also has a high durability to repeated impact.

7 Claims, 2 Drawing Sheets

GOLF BALL

CROSS-REFERENCE TO RELATED APPLICATION

This non-provisional application claims priority under 35 U.S.C. § 119(a) on Patent Application No. 2019-230379 filed in Japan on Dec. 20, 2019, the entire contents of which are hereby incorporated by reference.

TECHNICAL FIELD

The present invention relates to a golf ball of three or more pieces which has a core of at least one layer and a cover of at least two layers such as an intermediate layer and an is outermost layer.

BACKGROUND ART

Numerous three-piece and four-piece golf balls having a ball construction that includes a cover of two or more layers provided over a rubber core are currently on the market. In such multi-piece golf balls, for reasons having to do with the rebound, spin performance and other properties of the ball, the outer cover layer (also called the "outermost layer") and the inner cover layer (also called the "intermediate layer") are often formed of differing types of resin material.

Also, particularly in balls for professional golfers and skilled amateur golfers, urethane resin materials are commonly used in place of ionomer resin materials as the cover material making up the outermost layer. The combination of materials in the two-layer cover of the golf ball is often one in which the intermediate layer is formed of an ionomer resin and the outermost layer is formed of a polyurethane resin.

That is, in order to increase the spin rate on approach shots and achieve better controllability, a relatively soft material is used in the outermost layer, with the use of a polyurethane resin material being most common. In order to hold down the spin rate on shots with a driver and long and middle irons and thereby increase the distance traveled by the ball, a resin material having a relatively high rigidity is used in the intermediate layer, with the use of an ionomer resin material being most common. Numerous art relating to golf balls having such a structure has been disclosed. However, it is difficult to ensure a good durability to repeated impact in golf balls that have a highly rigid intermediate layer.

Although the durability to repeated impact of a golf ball obtained by encasing a core made of a rubber material with a thermoplastic resin is not always uniquely determined, it does depend to a large degree on the durability of the resin material itself within the thermoplastic resin encasing the core. Also, in golf balls having a cover layer made of a soft polyurethane resin and having an intermediate layer made of an ionomer resin, the durability of the ball strongly depends on the durability of the intermediate layer itself. That is, in such golf balls, when an ionomer of a higher rigidity is used in order to increase the distance of the ball, the durability of the golf ball to repeated impact worsens.

In addition, art which uses a high-rigidity ionomer resin material in the intermediate layer to enhance the distance performance and which increases the intermediate layer thickness to enhance the distance performance and to ensure durability on repeated impact has also been disclosed. However, in such golf balls, the feel at impact on shots with a driver (W#1) ends up worsening.

JP-A H09-56849 describes the use of a magnesium-type ionomer having a flexural rigidity of from 200 to 300 MPa as a golf ball resin material, and JP-A H10-127822 describes the use of a diamine complex ionomer having a flexural rigidity of from 340 to 410 MPa. However, in both of these golf balls, the flexural rigidity of the ionomer resin is low and the ball is too receptive to spin, resulting in an unsatisfactory flight performance. Nor is the durability to cracking especially good.

SUMMARY OF THE INVENTION

It is therefore an object of the present invention to provide a golf ball which, even when an ionomer resin is used as the resin material for the intermediate layer, has both an increased distance and an excellent durability to cracking.

As a result of extensive investigations, we have found that, in a golf ball which includes a rubber core of at least one layer and an intermediate layer and outermost layer which encase the core, by using a thermoplastic resin composition which possesses a flexural rigidity and a melt flow rate (MFR) within specific ranges as the intermediate layer-forming material and having this thermoplastic resin composition include, within a specific range in content, a magnesium salt of an ethylenically unsaturated carboxylic acid copolymer, by forming the outermost layer of a polyurethane resin composition and setting the material hardness thereof on the Shore D hardness scale to 55 or less, and by setting the deflection of the golf ball when compressed under a final load of 1,275 N (130 kgf) from an initial load state of 98 N (10 kgf) within a specific range, compared with golf balls made with the high-rigidity ionomer resins that have hitherto been used as intermediate layer materials, the spin rate of the ball on shots with a driver (W#1) and long and middle irons is suppressed, enabling an increased distance to be achieved, and a high durability to repeated impact is obtained.

Accordingly, the invention provides a golf ball that includes a rubber core of at least one layer and an intermediate layer and outermost layer which encase the core, wherein the intermediate layer is formed of a thermoplastic resin composition having a flexural rigidity of from 400 to 500 MPa and a melt flow rate of 15 g/10 min or less, which thermoplastic resin composition includes a magnesium salt of an ethylenically unsaturated carboxylic acid copolymer in a content of from 50 to 100 wt % of the overall composition; the outermost layer is formed of a polyurethane resin composition which has a material hardness on the Shore D hardness scale of 55 or less; and the golf ball has a deflection when compressed under a final load of 1,275 N (130 kgf) from an initial load state of 98 N (10 kgf) of from 2.2 to 3.8 mm.

In a preferred embodiment of the golf ball of the invention, the thermoplastic resin composition has a melt flow rate of 12 g/10 min or less.

In another preferred embodiment of the inventive golf ball, the thermoplastic resin composition has a flexural rigidity of at least 420 MPa.

In yet another preferred embodiment of the inventive golf ball, the thermoplastic resin composition includes a sodium salt of an ethylenically unsaturated carboxylic acid copolymer having a flexural rigidity of from 380 to 450 MPa.

In still another preferred embodiment, the thermoplastic resin composition includes an unneutralized ethylenically unsaturated carboxylic acid copolymer having a melt flow rate of from 30 to 500 g/10 min.

In a further preferred embodiment, the thermoplastic resin composition includes a metal oxide selected from the group consisting of magnesium oxide, zinc oxide, titanium oxide and aluminum oxide. The metal oxide is more preferably magnesium oxide.

In a still further preferred embodiment, the thermoplastic resin composition includes a cyclic carbodiimide compound.

Advantageous Effects of the Invention

The golf ball of the invention, when compared with conventional golf balls having the high-rigidity ionomer resins hitherto used as intermediate layer materials, suppresses the spin rate on shots with a driver (W#1) and long and middle irons, enabling an increased distance to be achieved, and also has a high durability to repeated impact.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
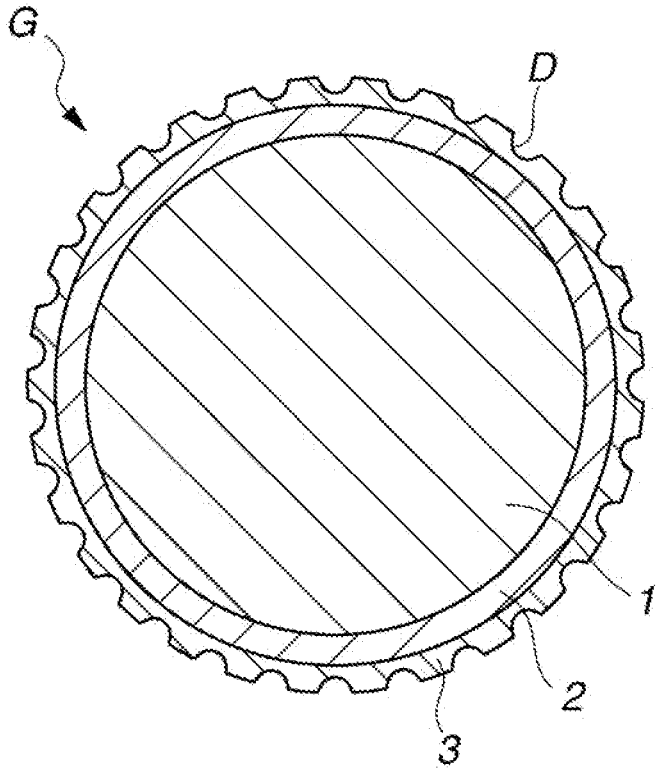
FIG. 1 is a schematic cross-sectional view of the golf ball according to one embodiment of the invention.

The golf ball of the invention has a rubber core of at least one layer and a cover that is formed over the core and composed of at least two layers: an intermediate layer and an outermost layer. For example, referring to FIG. 1, the golf ball G may have a core 1, an intermediate layer 2 encasing the core 1, and an outermost layer 3 encasing the intermediate layer 2. The outermost layer 3 is positioned as the outermost layer, apart from a coating layer, in the layered structure of the golf ball. Numerous dimples D are typically formed on the surface of the outermost layer 3 so as to improve the aerodynamic properties of the ball. Although not shown in the diagram, a coating layer is typically formed on the surface of the outermost layer 3.

The core may be formed using a known rubber composition. Although not particularly limited, the rubber composition is preferably one formulated as shown below.

The material that forms the core may be one which is composed largely of rubber. For example, the core may be formed using a rubber composition which contains a base rubber and also includes a co-crosslinking agent, an organic peroxide, an inert filler, sulfur, an antioxidant, an organosulfur compound and the like.

A polybutadiene is preferably used as the base rubber of the rubber composition. It is desirable for the polybutadiene to be one having a cis-1,4-bond content on the polymer chain of preferably at least 80 wt %, more preferably at least 90%, and even more preferably at least 95 wt %. When the cis-1,4-bond content among the bonds on the molecule is too low, the ball rebound may decrease. The polybutadiene has a content of 1,2-vinyl bonds on the polymer chain which is preferably not more than 2 wt %, more preferably not more than 1.7 wt %, and even more preferably not more than 1.5 wt %. At a 1,2-vinyl bond content which is too high, the rebound may decrease.

To obtain a vulcanizate of the rubber composition which has a good rebound, the polybutadiene included is preferably one synthesized with a rare-earth catalyst or a group VIII metal compound catalyst. One synthesized with a rare-earth catalyst is especially preferred.

Rubber ingredients other than the above polybutadiene may also be included in the rubber composition, so long as doing so does not detract from the advantageous effects of the invention. Such rubber ingredients other than the above polybutadiene include other polybutadienes and other diene rubbers, examples of which include styrene-butadiene rubber, natural rubber, isoprene rubber and ethylene-propylene-diene rubber.

Examples of co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The amount of unsaturated carboxylic acid and/or metal salt thereof included per 100 parts by weight of the base rubber may be set to preferably at least 5 parts by weight, more preferably at least 10 parts by weight, and even more preferably at least 15 parts by weight. The upper limit may be set to preferably not more than 60 parts by weight, more preferably not more than 50 parts by weight, and even more preferably not more than 45 parts by weight. Too much may make the core too hard, giving the ball an unpleasant feel at impact, whereas too little may lower the rebound.

A commercial product may be used as the organic peroxide. Specific examples include those available under the trade names Percumyl D, Perhexa 3M Perhexa C-40, Niper BW and Peroyl L (all products of NOF Corporation), and Luperco 231XL (AtoChem Co.). One of these may be used alone or two or more may be used together.

The amount of organic peroxide included per 100 parts by weight of the base rubber may be set to preferably at least 0.1 part by weight, more preferably at least 0.3 part by weight, even more preferably at least 0.5 part by weight, and most preferably at least 0.7 part by weight. The upper limit in the content may be set to preferably 5 parts by weight or less, more preferably 4 parts by weight or less, even more preferably 3 parts by weight or less, and most preferably 2 parts by weight or less. When too much or too little is included, it may not be possible to obtain a good feel at impact, durability and rebound.

Inert fillers that may be suitably used include zinc oxide, barium sulfate and calcium carbonate. One of these may be used alone or two or more may be used together.

The amount of inert filler included per 100 parts by weight of the base rubber may be set to preferably at least 1 part by weight, and more preferably at least 5 parts by weight. The upper limit in the content may be set to preferably 100 parts by weight or less, more preferably 80 parts by weight or less, and even more preferably 60 parts by weight or less. When too much or too little is included, it may be impossible to obtain a proper weight and a suitable rebound.

In addition, an antioxidant may be optionally included. Illustrative examples of suitable commercial antioxidants include Nocrac NS-6. Nocrac NS-30 and Nocrac 200 (available from Ouchi Shinko Chemical Industry Co., Ltd.), and Yoshinox 425 (available from Yoshitomi Pharmaceutical Industries, Ltd.). One of these may be used alone or two or more may be used together.

The antioxidant content per 100 parts by weight of the base rubber may be set to more than 0 part by weight, and is preferably at least 0.05 part by weight, and more preferably at least 0.1 part by weight. The upper limit in the content per 100 parts by weight of the base rubber is preferably not more than 3 parts by weight, more preferably not more than 2 parts by weight, even more preferably not more than 1 part by weight, and most preferably not more than 0.5 part by weight. When too much or too little is included, a suitable core hardness gradient may not be obtained, as a result of which it may not be possible to obtain a rebound, a durability and a spin rate-lowering effect on full shots that are suitable.

An organosulfur compound may be optionally included in the above rubber composition in order to increase the core rebound. When an organosulfur compound is included, the content thereof per 100 parts by weight of the base rubber may be set to preferably at least 0.05 part by weight, and more preferably at least 0.1 part by weight. The upper limit in the content may be set to preferably 5 parts by weight or less, more preferably 4 parts by weight or less, and even more preferably 2 parts by weight or less. When the organosulfur compound content is too low, a core rebound-enhancing effect may not be fully obtained. Conversely, when the content is too high, the core hardness may become too low, the feel of the ball at impact may worsen, and the durability of the ball to cracking on repeated impact may worsen.

The rubber composition containing the above ingredients is prepared by intensive mixture using an ordinary mixer such as a Banbury mixer or a roll mill. When using this rubber composition to produce the core, molding may be carried out by compression molding, injection molding or the like using a given mold for molding cores. The resulting molded body is heated and cured under temperature conditions sufficient for the organic peroxide and co-crosslinking agent included in the rubber composition to act, thereby giving a core having a given hardness profile. The vulcanization temperature in this case, although not particularly limited, is typically set to between about 130° C. and about 170° C.

The core diameter, although not particularly limited, is preferably at least 20 mm, more preferably at least 25 mm, and even more preferably at least 30 mm. The upper limit is preferably not more than 41 mm, and more preferably not more than 40 mm.

The core deflection, defined here as the amount of deformation by the core when compressed under a final load of 1,275 N (130 kgf) from an initial load state of 98 N (10 kgf), is preferably at least 2.0 mm, more preferably at least 2.5 mm, and even more preferably at least 2.7 mm. The upper limit is preferably not more than 6.0 mm, and more preferably not more than 5.0 mm. When this deformation value is too small, the feel of the ball at impact may be too hard. On the other hand, when this deformation value is too large, the feel at impact may be too soft or the durability to cracking on repeated impact may worsen.

A hardness difference between the center hardness and the surface hardness of the above core that is at or above a specific value, specifically a JIS-C hardness of 20 or more, is desirable from the standpoint of obtaining the desired initial velocity, feel at impact, spin performance and durability.

The intermediate layer used in this invention is formed using a thermoplastic resin composition having a flexural rigidity of from 400 to 500 MPa and a melt flow rate (MFR) of not more than 15 g/10 min.

To achieve the desired effects of the invention, that is, to achieve both an improved durability to cracking and an increased distance, it is critical for the thermoplastic resin composition to have a flexural rigidity, as measured based on JIS K 7106 (1995), which is at least 400 MPa, and preferably at least 420 MPa, and which is not more than 500 MPa.

In order for the thermoplastic resin composition to have a good flowability and molding processability during injection molding, the melt flow rate of the thermoplastic resin composition, as measured in accordance with JIS-K7210 at a test temperature of 190° C. and a test load of 21.18 N (21.6 kgf), must be not more than 15 g/10 min, and is preferably not more than 12 g/10 min. It is recommended that the lower limit be preferably at least 0.5 g/10 min, and more preferably at least 1.0 g/10 min.

The thermoplastic resin composition includes a magnesium salt of an ethylenically unsaturated carboxylic acid copolymer. Preferred examples of magnesium salts of ethylenically unsaturated carboxylic acid copolymer include ionomer resins which are ethylene-unsaturated carboxylic acid copolymers and/or ethylene-unsaturated carboxylic acid-unsaturated carboxylic acid ester copolymers in which acid groups on the polymer are neutralized with at least magnesium ions. Here, it is preferable to use acrylic acid (AA), methacrylic acid (MAA) or the like as the unsaturated carboxylic acid. The use of methacrylic acid (MAA) is especially preferred. The unsaturated carboxylic acid ester is preferably a lower alkyl ester. Butyl acrylate (n-butyl acrylate, i-butyl acrylate) is especially preferred.

The content of unsaturated carboxylic acid (acid content) in the ethylenically unsaturated carboxylic acid copolymer, although not particularly limited, is preferably at least 15 wt %, and not more than 26 wt %, and more preferably at least 17 wt % and not more than 23 wt %. When this content is low, a good resilience by the molded golf ball material may not be obtained. On the other hand, at a high acid content, the hardness may become extremely high, which may adversely affect the durability.

The degree of neutralization of acid groups in the ethylenically unsaturated carboxylic acid copolymer by magnesium ions is preferably at least 20 mol %, more preferably at least 25 mol %, and even more preferably at least 30 mol %.

Acid groups in the ethylenically unsaturated carboxylic acid copolymer may be neutralized as well with metal ions other than magnesium ions, such as sodium ions and zinc ions. In this case, it is preferable for the acid content and the degree of neutralization to be similar to those mentioned above for the magnesium salt.

The magnesium salt of the ethylenically unsaturated carboxylic acid copolymer may serve as the chief component of the thermoplastic resin composition. Specifically, it accounts for preferably at least 50 wt %, more preferably at least 60 wt %, and up to 10 wt %, of the overall thermoplastic resin composition.

The thermoplastic resin composition serving as the intermediate layer material used in this invention may also include other thermoplastic resins, insofar as doing so does not detract from the advantageous effects of the invention. Illustrative, non-limiting examples of specific thermoplastic resins that may be optionally included are polyolefin elastomers (including polyolefins and metallocene polyolefins), polystyrene elastomers, diene polymers, polyacrylate polymers, polyamide elastomers, polyurethane elastomers, polyester elastomers and polyacetals.

As already mentioned, the above thermoplastic resin composition includes a magnesium salt of an ethylenically unsaturated carboxylic acid copolymer. A sodium salt of an ethylenically unsaturated carboxylic acid copolymer may also be included together with this. In such a case, the sodium salt of the ethylenically unsaturated carboxylic acid copolymer is a sodium salt of an ethylene-acrylic acid copolymer or an ethylene-methacrylic acid copolymer. The flexural rigidity of this sodium salt of the ethylenically unsaturated carboxylic acid copolymer is preferably from 380 to 450 MPa.

For reasons having to do with processability, the above thermoplastic resin composition may include an unneutralized ethylenically unsaturated carboxylic acid copolymer having a melt flow rate of from 30 to 500 g/10 min. In this case, from the standpoint of the spin rate and the durability to repeated impact of the resulting ball, the unsaturated carboxylic acid content (acid content) in the ethylenically unsaturated carboxylic acid copolymer is preferably at least 18 wt % and not more than 23 wt %.

A metal oxide such as magnesium oxide, zinc oxide, titanium oxide or aluminum oxide may be suitably included in the thermoplastic resin composition in order to adjust the degree of neutralization. Of these, the use of magnesium oxide is more preferred.

A cyclic carbodiimide may be suitably included in the thermoplastic resin composition so as to enhance the heat resistance during processing, adjust the viscosity and improve the durability of the ball to repeated impact. The amount of cyclic carbodiimide added in this case, although not particularly limited, is preferably from 0.005 to 10 wt %, and more preferably from 0.01 to 5 wt %, of the overall thermoplastic resin composition.

In addition, depending on the intended use of the thermoplastic resin composition, optional additives may be suitably included therein. For example, various additives such as pigments, dispersants, antioxidants, ultraviolet absorbers and light stabilizers may be added. When these additives are included, the content thereof per 100 parts by weight of the overall resin composition is preferably at least 0.1 wt %, and more preferably at least 0.5 wt %. The upper limit is preferably not more than 10 wt %, and more preferably not more than 4 wt %.

The intermediate layer molded from the thermoplastic resin composition has a material hardness on the Shore D hardness scale which is preferably at least 60, and more preferably at least 65. The upper limit is preferably not more than 75.

The intermediate layer thickness, although not particularly limited, is preferably at least 0.5 mm, and more preferably at least 0.7 mm. The upper limit is preferably not more than 1.2 mm, more preferably not more than 1.1 mm, and even more preferably not more than 0.9 mm.

In this invention, to achieve overall the desired ball performance, the outermost layer of the cover may be formed using a polyurethane resin material as the chief component. This polyurethane resin material, although not particularly limited, is preferably a thermoplastic polyurethane elastomer or a thermoset urethane resin, with the use of a thermoplastic polyurethane elastomer being especially preferred.

The thermoplastic polyurethane elastomer is not particularly limited, provided it is an elastomer composed primarily of polyurethane. A morphology that includes soft segments composed of a high-molecular-weight polyol compound and hard segments composed of a diisocyanate and a monomolecular chain extender is preferred.

Exemplary polymeric polyol compounds include, but are not particularly limited to, polyester polyols and polyether polyols. From the standpoint of rebound resilience or low-temperature properties, the use of a polyether polyol is preferred. Examples of polyether polyols include polytetramethylene glycol and polypropylene glycol, with the use of polytetramethylene glycol being especially preferred. These compounds have a number-average molecular weight of preferably from 1,000 to 5,000, and more preferably from 1,500 to 3,000.

Exemplary diisocyanates include, but are not particularly limited to, aromatic diisocyanates such as 4,4'-diphenylmethane diisocyanate, 2,4-toluene diisocyanate and 2,6-toluene diisocyanate; and aliphatic diisocyanates such as hexamethylene diisocyanate. In the practice of this invention, from the standpoint of reaction stability with the subsequently described isocyanate mixture when blended therewith, the use of 4,4'-diphenylmethane diisocyanate is preferred.

The monomolecular chain extender is not particularly limited, although use can be made of an ordinary polyol or polyamine. Specific examples include 1,4-butylene glycol, 1,2-ethylene glycol, 1,3-propylene glycol, 1,3-butanediol, 1,6-hexylene glycol, 2,2-dimethyl-1,3-propanediol, 1,3-butylene glycol, dicyclohexylmethylmethanediamine (hydrogenated MDA) and isophoronediamine (IPDA). These chain extenders have average molecular weights of preferably from 20 to 15,000.

A commercial product may be used as the polyurethane elastomer. Illustrative examples include Pandex T7298, TR3080, T8230, T8290, T8293, T8295 and T8260 (all available from DIC Covestro Polymer, Ltd.), and Resamine 2593 and 2597 (available from Dainichiseika Color & Chemicals Mfg. Co., Ltd.). These may be used singly, or two or more may be used in combination.

Various additives may be optionally included in the polyurethane resin material that forms the outermost layer. For example, pigments, dispersants, antioxidants, light stabilizers, ultraviolet absorbers and internal mold lubricants may be suitably included.

The outermost layer has a thickness which, although not particularly limited, is preferably at least 0.5 mm, and more preferably at least 0.7 mm. The upper limit is preferably not more than 1.2 mm, more preferably not more than 1.1 mm, and even more preferably not more than 0.9 mm.

The outermost layer has a hardness on the Shore D hardness scale which, although not particularly limited, is preferably at least 30, and more preferably at least 40. The upper limit may be set to preferably not more than 55, more preferably not more than 50, and even more preferably not more than 45.

The method used to form the intermediate layer and the outermost layer may be a known method and is not particularly limited. For example, use may be made of the method of placing a prefabricated core or an intermediate layer-encased sphere within a mold, and then injection-molding the intermediate layer-forming resin material prepared as described above over the core or injection molding the outermost layer-forming resin material prepared as described above over the intermediate layer-encased sphere.

The ball deflection, defined as deformation by the ball when compressed under a final load of 1,275 N (130 kgf) from an initial load state of 98 N (10 kgf), is at least 2.2 mm and not more than 3.8 mm. When this deformation value is too small, the feel of the ball at impact becomes too hard. On the other hand, when this deformation value is too large, the feel at impact may be too soft or the durability of the ball to cracking on repeated impact worsens.

Numerous dimples may be formed on the outside surface of the outermost layer. The number of dimples arranged on the surface of the outermost layer, although not particularly limited, is preferably at least 250, more preferably at least 300, and even more preferably at least 320. The upper limit is preferably not more than 440, more preferably not more than 400, and even more preferably not more than 360. When the number of dimples is larger than this range, the ball trajectory may become lower and the distance traveled by the ball may decrease. On the other hand, when the number of dimples is smaller that this range, the ball trajectory may become higher and a good distance may not be achieved. The arrangement of these dimples may have symmetry that follows a tetrahedral, octahedral, dodecahedral or other polyhedral/polygonal shape, or may have rotational symmetry along an axis connecting the poles of the ball.

It is recommended that preferably two or more dimple types, and more preferably three or more dimple types, of mutually differing diameter and/or depth be formed. With regard to the planar shapes of the dimples, a single dimple shape or a combination of two or more dimple shapes, such as circular shapes, various polygonal shapes, dewdrop shapes and oval shapes, may be suitably used. For example, when circular dimples are used, the dimple diameter may be set to at least about 2.5 mm and up to about 6.5 mm, and the dimple depth may be set to at least 0.07 mm and up to 0.30 mm. The cross-sectional shapes of the dimples may be defined as one or a combination of two or more types, including arcuate shapes, conical shapes, flat-bottomed shapes and curves expressed by various functions, and may have, other than near the dimple edges, a plurality of inflection points.

In order for the aerodynamic properties to be fully manifested, it is desirable for the dimple coverage ratio, i.e., the dimple surface coverage SR, which is the collective surface area of the imaginary spherical surfaces circumscribed by the edges of the individual dimples, as a percentage of the spherical surface area of the golf ball, to be set to at least 70% and not more than 90%. Also, to optimize the ball trajectory, it is desirable for the value Vo, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of the dimple, with respect to the volume of the ball sphere were the ball to have no dimples on its surface, to be set to at least 0.6% and not more than 1.0%. Outside of the above ranges in these respective values, the resulting trajectory may not enable a good distance to be achieved and so the ball may fail to travel a fully satisfactory distance. Also, in order to satisfy the rule for symmetry of the ball's carry, dimple volumes near the poles may be made smaller and dimple volumes near the equator may be made larger than the volumes of dimples away from the poles and the equator.

In addition, various types of coatings may be applied onto the cover surface. Given that it needs to be able to endure the harsh conditions of golf ball use, this coating is preferably a two-part curable urethane coating, especially a non-yellowing urethane coating.

Ball specifications such as the ball weight and diameter may be suitably set in accordance with the Rules of Golf.

EXAMPLES

The following Examples and Comparative Examples are provided to illustrate the invention, and are not intended to limit the scope thereof.

Examples 1 to 15, Comparative Examples 1 to 13

A rubber composition formulated as shown in Table 1 below and common to all of the Examples except Comparative Examples 11 and 12 was vulcanized at 155° C. for 15 minutes, thereby producing solid cores for each Example. As to Comparative Examples 11 and 12, the solid cores are produced by the same composition as the rubber composition shown in Table 1 and the same conditions as described above.

TABLE 1

| Core-forming rubber composition (C1) | parts by weight |
|---|---|
| cis-1,4-Polybutadiene | 100 |
| Zinc acrylate | 34 |
| Zinc oxide | 15.5 |
| Zinc methacrylate | 1.0 |
| Antioxidant | 0.1 |
| Organic peroxide | 1.0 |
| Zinc salt of pentachlorothiophenol | 1.0 |
| Water | 0.4 |

Details on the ingredients in the above core material are given below.

cis-1,4-Polybutadiene: Available under the trade name "BR 01" from JSR Corporation Zinc acrylate: Available from Nippon Shokubai Co., Ltd.

Zinc oxide: Available from Sakai Chemical Co., Ltd.

Zinc methacrylate: Available from Asada Chemical Industry Co., Ltd.

Antioxidant: Available under the trade name "Nocrac NS6" from Ouchi Shinko Chemical Industry Co., Ltd.

Organic peroxide: Dicumyl peroxide, available under the trade name "Percumyl D" from NOF Corporation Water: Distilled water Formation of Cover Layers (Intermediate Layer and Outermost Layer)

Next, a 1.3 mm-thick intermediate layer was injection-molded from Resin Materials M1 to M28 formulated as shown in Tables 2 and 3 below over the 38.5 mm-diameter core obtained above, thereby producing an intermediate layer-encased sphere. The outermost layer material (cover material) shown in Table 4 and common to all of the Examples except Comparative Examples 11 and 12 was then injection-molded to a thickness of 0.8 mm over the intermediate layer-encased sphere, producing a three-piece golf ball. Although not shown in the diagrams, an arrangement of dimples common to all of the Examples and Comparative Examples except Comparative Examples 11 and 12 was formed on the cover surface at this time.

As to Comparative Examples 11 and 12, the intermediate layer-encased spheres and a three-piece golf ball are produced in order by the same procedures as described above.

TABLE 2

| Ingredients (pbw) | Flexural rigidity (MPa) | Hardness (Shore D) | Metal ions | Acid content (wt %) | MFR (g/10 min) | M1 | M2 | M3 | M4 | M5 | M6 | M7 | M8 | M9 | M10 |
|---|---|---|---|---|---|---|---|---|---|---|---|---|---|---|---|
| Ionomer A | 420 | 67 | Na | 18 | 2 | 100 | | | | | | | | | |
| Ionomer B | 440 | 68 | Na | 19.5 | 3 | | 100 | | | | | | | | |
| Ionomer C | 430 | 67 | Na | 19 | 3 | | | 100 | | | | | | | |
| Ionomer D | 410 | 67 | Na | 19 | 2 | | | | 100 | | | | | | |
| Ionomer E | 320 | 65 | Na | 15 | 3 | | | | | 100 | | | | | |
| Ionomer F | 390 | 66 | Na | 18 | 5 | | | | | | 100 | | | | |
| Ionomer G | 290 | 66 | Zn | 19 | 2 | | | | | | | 100 | | | |
| Ionomer H | 330 | 67 | Zn | 19 | 1 | | | | | | | | 100 | | |
| Ionomer I | 300 | 65 | Zn | 18 | 1 | | | | | | | | | 100 | |
| Ionomer J | 330 | 67 | Zn | 19.5 | 2 | | | | | | | | | | 100 |
| Ionomer K | 420 | 67 | Mg | 19 | 7 | | | | | | | | | | |
| Ionomer L | 430 | 67 | Mg | 19 | 3 | | | | | | | | | | |
| Ionomer M | 420 | 69 | Mg | 19.5 | 2 | | | | | | | | | | |
| Ionomer N | 410 | 67 | Mg | 18.5 | 7 | | | | | | | | | | |
| Ionomer O | 425 | 67 | Mg | 19 | 4 | | | | | | | | | | |
| Ionomer P | 256 | 63 | Mg | 15 | 1 | | | | | | | | | | |
| Ionomer Q | 390 | 67 | Mg | 19 | 1 | | | | | | | | | | |
| Nucrel 2060 | — | 62 | — | 20 | 60 | | | | | | | | | | |
| Nucrel 2050H | — | 53 | — | 20 | ≈500 | | | | | | | | | | |
| Cyclic carbodiimide | — | — | — | — | — | | | | | | | | | | |
| Polyol | — | — | — | — | — | | | | | | | | | | |
| Magnesium oxide | — | — | — | — | — | | | | | | | | | | |

TABLE 3

| Ingredients (pbw) | M11 | M12 | M13 | M14 | M15 | M16 | M17 | M18 | M19 | M20 | M21 | M22 | M23 | M24 | M25 | M26 | M27 | M28 |
|---|---|---|---|---|---|---|---|---|---|---|---|---|---|---|---|---|---|---|
| Ionomer A | | | | | | | | 50 | 80 | | 15 | | | | | | | |
| Ionomer B | | | | | | | | | | | | | | | | | | |
| Ionomer C | | | | | | | | | | | | | | | | | | |
| Ionomer D | | | | | | | | | | | | | | | | | | |
| Ionomer E | | | | | | | | | | 50 | | | | | | | | |
| Ionomer F | | | | | | | | | | | | | | | | | | |
| Ionomer G | | | | | | | | | | | | | | | | | | |
| Ionomer H | | | | | | | | | | | | | | | | | | |
| Ionomer I | | | | | | | | | | | | | | | | | | |
| Ionomer J | | | | | | | | | | | | | | | | | | |
| Ionomer K | 100 | | | | | | | | | | | | | | | | | |
| Ionomer L | | 100 | | | | | | | | | | | | | | | | |
| Ionomer M | | | 100 | | | | | 50 | 20 | 50 | 75 | 85 | 85 | 100 | 100 | 100 | 100 | 100 |
| Ionomer N | | | | 100 | | | | | | | | | | | | | | |
| Ionomer O | | | | | 100 | | | | | | | | | | | | | |
| Ionomer P | | | | | | 100 | | | | | | | | | | | | |
| Ionomer Q | | | | | | | 100 | | | | | | | | | | | |
| Nucrel 2060 | | | | | | | | | | | 10 | 15 | | | | | | |
| Nucrel 2050H | | | | | | | | | | | | | 15 | | | | | |
| Cyclic carbodiimide | | | | | | | | | | | | | | 0.05 | 0.1 | 1 | | |
| Polyol | | | | | | | | | | | | | | 1.1 | 1.1 | 1.1 | | |
| Magnesium oxide | | | | | | | | | | | | | | | | | 0.1 | 0.3 |

Details on the materials in these tables are as follows.

Ionomers A to F: Sodium salts of ethylene-methacrylic acid copolymers

Ionomers G to J: Zinc salts of ethylene-methacrylic acid copolymers

Ionomers K to Q: Magnesium salts of ethylene-methacrylic acid copolymers

Nucrel 2060, Nucrel 2050H:

Unneutralized ethylene-unsaturated carboxylic acid copolymers available from Dow-Mitsui Polychemicals Co., Ltd.

Cyclic carbodiimide: Available under the trade name Carbosista from Teijin Limited Polyol: Trimethylolpropane available from Mitsubishi Gas Chemical Company, Inc.

Magnesium oxide: Available from Kyowa Chemical Industry Co., Ltd.

TABLE 4

| Outermost layer resin material (O1) | parts by weight |
|---|---|
| T-8290 | 67 |
| T-8283 | 22 |
| Hytrel 4001 | 11 |
| Isocyanate mixture | 6.7 |

TABLE 4-continued

| Outermost layer resin material (O1) | parts by weight |
|---|---|
| Polyethylene wax | 2.4 |
| Titanium oxide | 2.9 |

Details on the materials in Table 4 are given below.

T-8290, T-8283: Ether-type thermoplastic polyurethanes available under the trade name "Pandex" from DIC Covestro Polymer, Ltd.

Hytrel 4001: A polyester elastomer available from DuPont-Toray Co., Ltd.

Isocyanate compound: 4,4'-Diphenylmethane diisocyanate

Properties of the resulting golf balls, including the diameters of the core, intermediate layer-encased sphere and ball, the thickness and material hardness of each layer, and the surface hardness and deformation (deflection) under specific loading of each layer-encased sphere, were evaluated by the following methods and shown in Tables 5 and 6. In addition, the initial velocity, spin rate and durability to impact of the golf ball produced in each Example were evaluated by the following methods. These results are also presented in Tables 5 and 6.

Diameters of Core and Intermediate Layer-Encased Sphere

The diameters at five random places on the surface were measured at a temperature of 23.9±1° C. and, using the average of these measurements as the measured value for a single core or intermediate layer-encased sphere, the average diameter for five measured cores or intermediate layer-encased spheres was determined.

Ball Diameter

The diameter at five random, dimple-free areas was measured at a temperature of 23.9±1° C. and, using the average of these measurements as the measured value for a single ball, the average diameter for five balls was determined.

Deflections of Core, Intermediate Layer-Encased Sphere and Ball

A core, intermediate layer-encased sphere or ball was placed on a hard plate and the amount of deflection by each sphere when compressed under a final load of 1,275 N (130 kgf) from an initial load state of 98 N (10 kgf) was measured. The amount of deflection refers in each case to the measured value obtained after holding the test specimen isothermally at 23.9° C.

Material Hardnesses of Intermediate Layer and Outermost Layer (Shore D Hardnesses)

The intermediate layer and outermost layer-forming resin materials were molded into sheets having a thickness of 2 mm and left to stand for at least two weeks, following which their Shore D hardnesses were measured in accordance with ASTM D2240-95.

Initial Velocity

The initial velocity was measured using an initial velocity measuring apparatus of the same type as the USGA drum rotation-type initial velocity instrument approved by the R&A. The ball was tested in a chamber at a room temperature of 23±2° C. after being held isothermally at a temperature of 23±1° C. for at least 3 hours. Ten balls were each hit two times. The time taken for the ball to traverse a distance of 6.28 ft (1.91 m) was measured and used to compute the initial velocity. The difference relative to the measured value for the initial velocity in Comparative Example 1 is shown in the tables.

Spin Rate on Shots with a Driver (W#1) and Middle Iron (I#6)

A driver (W#1) was mounted on a golf swing robot and the rate of backspin immediately after hitting the ball at a head speed (HS) of 45 m/s was measured with an apparatus for measuring the initial conditions.

Figure 2:
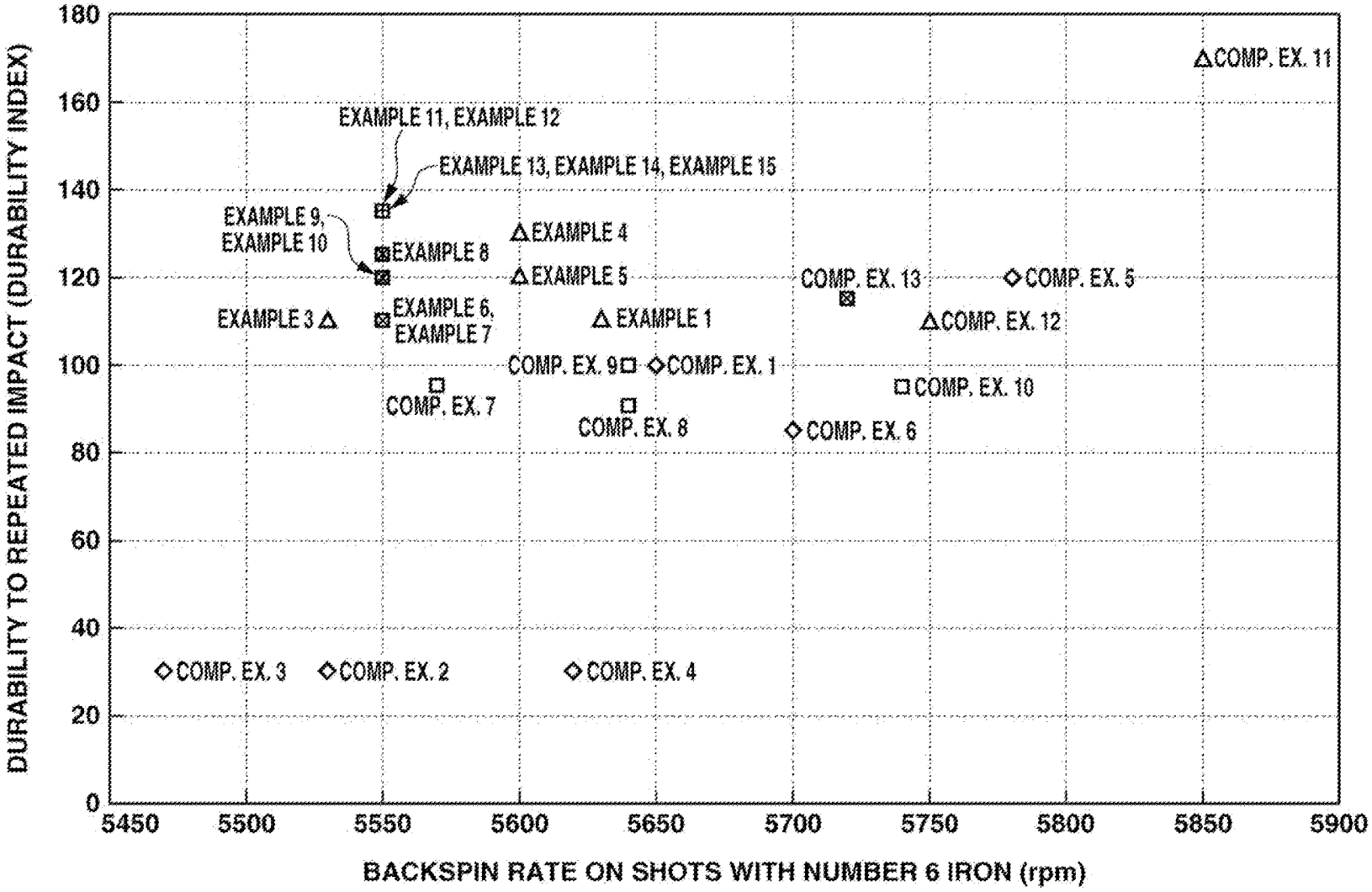
FIG. 2 is a graph showing the relationship between the spin rate of shots with a number six iron (I#6) and the durability to cracking by golf balls in the Examples of the invention and in the Comparative Examples.

Also, a number six iron (I#6) was mounted on a golf swing robot and the rate of backspin immediately after hitting the ball at a head speed (HS) of 37 m/s was measured with an apparatus for measuring the initial conditions. FIG. 2 shows a graph of the relationship between the spin rate on shots with a number six iron (I#6) of the balls obtained in the respective Examples and Comparative Examples and the durability of each ball to cracking.

Durability to Impact

The durability of the golf ball was evaluated using an ADC Ball COR Durability Tester produced by Automated Design Corporation (U.S.). This tester fires a golf ball pneumatically and causes it to repeatedly strike two metal plates arranged in parallel. The incident velocity against the metal plates was set to 43 m/s. The number of shots required for the golf ball to crack was measured. Durability indices for the balls in the respective Examples were calculated relative to an arbitrary value of 100 for the number of shots required for the ball obtained in Comparative Example 1 to crack.

TABLE 5

| | | Comparative Example | | | | | | | |
|---|---|---|---|---|---|---|---|---|---|
| | | 1 | 2 | 3 | 4 | 5 | 6 | 7 | 8 |
| Core | Composition | C1 | C1 | C1 | C1 | C1 | C1 | C1 | C1 |
| | Diameter (mm) | 38.5 | 38.5 | 38.5 | 38.5 | 38.5 | 38.5 | 38.5 | 38.5 |
| | Weight (g) | 35.1 | 35.1 | 35.1 | 35.1 | 35.1 | 35.1 | 35.1 | 35.1 |
| | Deflection (mm) | 2.9 | 2.9 | 2.9 | 2.9 | 2.9 | 2.9 | 2.9 | 2.9 |
| Intermediate layer | Composition | M1 | M2 | M3 | M4 | M5 | M6 | M7 | M8 |
| | Flexural rigidity (MPa) | 420 | 440 | 430 | 410 | 310 | 390 | 290 | 330 |
| | Shore D hardness | 67 | 68 | 67 | 67 | 65 | 66 | 66 | 67 |
| | MFR (g/10 min) | 2.2 | 2.7 | 3.2 | 2.1 | 2.8 | 5.2 | 1.8 | 0.7 |

TABLE 5-continued

| | | | | | | | | | |
|---|---|---|---|---|---|---|---|---|---|
| Intermediate layer-encased sphere | Diameter (mm) | 41.0 | 41.0 | 41.0 | 41.0 | 41.0 | 41.0 | 41.0 | 41.0 |
| | Weight (g) | 40.7 | 40.7 | 40.7 | 40.7 | 40.7 | 40.7 | 40.7 | 40.7 |
| | Deflection (mm) | 2.6 | 2.6 | 2.6 | 2.6 | 2.5 | 2.5 | 2.5 | 2.6 |
| Outermost layer | Composition | O1 | O1 | O1 | O1 | O1 | O1 | O1 | O1 |
| | Shore D hardness | 47 | 47 | 47 | 47 | 47 | 47 | 47 | 47 |
| Ball | Diameter (mm) | 42.7 | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 | 45.5 |
| | Deflection (mm) | 2.4 | 2.4 | 2.4 | 2.4 | 2.4 | 2.4 | 2.4 | 2.4 |
| | Initial velocity (m/s) | 0.0 | 0.0 | 0.0 | 0.0 | −0.2 | 0.0 | −0.1 | −0.1 |
| | Spin rate on W#1 shot (rpm) | 2,860 | 2,840 | 2,840 | 2,860 | 2,930 | 2,900 | 2,880 | 2,855 |
| | Spin rate on I#6 shot (rpm) | 5,650 | 5,530 | 5,470 | 5,620 | 5,780 | 5,700 | 5,570 | 5,640 |
| | Durability to impact (index) | 100 | 30 | 30 | 30 | 120 | 85 | 95 | 90 |

| | | Comparative Example | | Example | | | | |
|---|---|---|---|---|---|---|---|---|
| | | 9 | 10 | 1 | 2 | 3 | 4 | 5 |
| Core | Composition | C1 | C1 | C1 | C1 | C1 | C1 | C1 |
| | Diameter (mm) | 38.5 | 38.5 | 38.5 | 38.5 | 38.5 | 38.5 | 38.5 |
| | Weight (g) | 35.1 | 35.1 | 35.1 | 35.1 | 35.1 | 35.1 | 35.1 |
| | Deflection (mm) | 2.9 | 2.9 | 2.9 | 2.9 | 2.9 | 2.9 | 2.9 |
| Intermediate layer | Composition | M9 | M10 | M11 | M12 | M13 | M14 | M15 |
| | Flexural rigidity (MPa) | 300 | 330 | 420 | 430 | 420 | 410 | 425 |
| | Shore D hardness | 65 | 67 | 67 | 67 | 69 | 67 | 67 |
| | MFR (g/10 min) | 1.3 | 1.8 | 6.8 | 2.8 | 2.0 | 6.9 | 3.8 |
| Intermediate layer-encased sphere | Diameter (mm) | 41.0 | 41.0 | 41.0 | 41.0 | 41.0 | 41.0 | 41.0 |
| | Weight (g) | 40.7 | 40.7 | 40.7 | 40.7 | 40.7 | 40.7 | 40.7 |
| | Deflection (mm) | 2.5 | 2.6 | 2.6 | 2.6 | 2.6 | 2.6 | 2.6 |
| Outermost layer | Composition | O1 | O1 | O1 | O1 | O1 | O1 | O1 |
| | Shore D hardness | 47 | 47 | 47 | 47 | 47 | 47 | 47 |
| Ball | Diameter (mm) | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 |
| | Deflection (mm) | 2.4 | 2.4 | 2.4 | 2.4 | 2.5 | 2.4 | 2.4 |
| | Initial velocity (m/s) | −0.2 | −0.1 | 0.1 | 0.0 | 0.1 | 0.0 | 0.1 |
| | Spin rate on W#1 shot (rpm) | 2,880 | 2,850 | 2,870 | 2,875 | 2,875 | 2,875 | 2,875 |
| | Spin rate on I#6 shot (rpm) | 5,640 | 5,740 | 5,630 | 5,600 | 5,530 | 5,600 | 5,600 |
| | Durability to impact (index) | 100 | 95 | 110 | 130 | 110 | 130 | 120 |

TABLE 6

| | | Comparative Example | | Example | | Comp Ex. | Example | | | | | | | |
|---|---|---|---|---|---|---|---|---|---|---|---|---|---|---|
| | | 11 | 12 | 6 | 7 | 13 | 8 | 9 | 10 | 11 | 12 | 13 | 14 | 15 |
| Core | Composition | C1 | C1 | C1 | C1 | C1 | C1 | C1 | C1 | C1 | C1 | C1 | C1 | C1 |
| | Diameter (mm) | 38.5 | 38.5 | 38.5 | 38.5 | 38.5 | 38.5 | 38.5 | 38.5 | 38.5 | 38.5 | 38.5 | 38.5 | 38.5 |
| | Weight (g) | 35.1 | 35.1 | 35.1 | 35.1 | 35.1 | 35.1 | 35.1 | 35.1 | 35.1 | 35.1 | 35.1 | 35.1 | 35.1 |
| | Deflection (mm) | 2.9 | 2.9 | 2.9 | 2.9 | 2.9 | 2.9 | 2.9 | 2.9 | 2.9 | 2.9 | 2.9 | 2.9 | 2.9 |
| Intermediate layer | Composition | M16 | M17 | M18 | M19 | M20 | M21 | M22 | M23 | M24 | M25 | M26 | M27 | M28 |
| | Flexural rigidity (MPa) | 256 | 390 | 420 | 420 | 365 | 425 | 430 | 430 | 430 | 430 | 430 | 430 | 430 |
| | Shore D hardness | 63 | 67 | 68 | 67 | 67 | 67 | 67 | 67 | 69 | 69 | 69 | 69 | 69 |
| | MFR (g/10 min) | 0.9 | 1.3 | 2.0 | 2.2 | 1.7 | 2.8 | 3.1 | 5.0 | 1.4 | 1.3 | 1.3 | 1.5 | 1.2 |
| Intermediate layer-encased sphere | Diameter (mm) | 41.0 | 41.0 | 41.0 | 41.0 | 41.0 | 41.0 | 41.0 | 41.0 | 41.0 | 41.0 | 41.0 | 41.0 | 41.0 |
| | Weight (g) | 40.7 | 40.7 | 40.7 | 40.7 | 40.7 | 40.7 | 40.7 | 40.7 | 40.7 | 40.7 | 40.7 | 40.7 | 40.7 |
| | Deflection (mm) | 2.5 | 2.6 | 2.6 | 2.6 | 2.6 | 2.6 | 2.6 | 2.6 | 2.6 | 2.6 | 2.6 | 2.6 | 2.6 |
| Outermost layer | Composition | O1 | O1 | O1 | O1 | O1 | O1 | O1 | O1 | O1 | O1 | O1 | O1 | O1 |
| | Shore D hardness | 47 | 47 | 47 | 47 | 47 | 47 | 47 | 47 | 47 | 47 | 47 | 47 | 47 |
| Ball | Diameter (mm) | 42.7 | 42.7 | 42.7 | 42.7 | 42.7 | 42.7 | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 | 45.5 | 45.5 | 45.5 | 45.5 | 45.5 | 45.5 |
| | Deflection (mm) | 2.3 | 2.4 | 2.4 | 2.4 | 2.4 | 2.4 | 2.4 | 2.4 | 2.5 | 2.5 | 2.5 | 2.5 | 2.5 |
| | Initial velocity (m/s) | −0.3 | 0.0 | 0.2 | 0.2 | 0.1 | 0.0 | 0.0 | 0.0 | 0.1 | 0.0 | 0.1 | 0.0 | 0.0 |
| | Spin rate on W#1 shot (rpm) | 2,950 | 2,900 | 2,860 | 2,860 | 2,900 | 2,860 | 2,860 | 2,860 | 2,860 | 2,860 | 2,860 | 2,860 | 2,860 |
| | Spin rate on I#6 shot (rpm) | 5,850 | 5,750 | 5,550 | 5,550 | 5,720 | 5,550 | 5,550 | 5,550 | 5,550 | 5,550 | 5,550 | 5,550 | 5,550 |
| | Durability to impact (index) | 170 | 110 | 110 | 110 | 115 | 125 | 120 | 120 | 135 | 135 | 135 | 135 | 135 |

The following was observed from the ball performances in the Examples shown in Tables 5 and 6 and from the graph in FIG. 2.

Comparative Examples 1, 2, 3, 4 and 6 are Examples in which sodium ionomers having a relatively high flexural rigidity were used as the intermediate layer material. As a result, the rate of backspin on shots with a number six iron was relatively low, holding down the rise of the ball during flight and enabling the ball to fly well. However, the durability to repeated impact was poor.

Comparative Example 5 is an Example in which a sodium ionomer was used as the intermediate layer material. The durability to repeated impact was good, but the rate of backspin on shots with a number six iron was high, which was undesirable.

Comparative Examples 7, 8, 9 and 10 are Examples in which zinc ionomers were used as the intermediate layer material. The durability to repeated impact was poor in each of these Examples.

Comparative Examples 11 and 12 are Examples in which magnesium ionomers having a relatively low flexural rigidity are used as the intermediate layer material. The rate of backspin on shots with a number six iron is high, which is undesirable.

Examples 1 to 5 according to the present invention are Examples in which magnesium ionomers having a high flexural rigidity were used as the intermediate layer material. The rate of backspin on shots with a number six iron was low and the durability to repeated impact was high.

Also, in Examples 6 and 7 which, compared with Example 1, used resin compositions containing given amounts of sodium ionomers having a high flexural rigidity as the intermediate layer-forming material, a high durability to repeated impact and a backspin rate-suppressing effect on shots with a number six iron similar to those in Example 1 were observed. Likewise, in Examples 8, 9 and 10 which, compared with Example 1, used resin compositions containing given amounts of unneutralized ethylenically unsaturated carboxylic acid copolymers having a melt flow rate of from 30 to 500 g/10 min as the intermediate layer-forming material, a high durability to repeated impact and a backspin rate-suppressing effect on shots with a number six iron similar to those in Example 1 were observed.

Additionally, in Examples 11, 12 and 13 which, compared with Example 1, used resin compositions containing cyclic carbodiimides as the intermediate layer-forming material, a high durability to repeated impact and a backspin rate-suppressing effect on shots with a number six iron similar to those in Example 1 were observed. Likewise, in Examples 14 and 15 which, compared with Example 1, used resin compositions containing given metal oxides as the intermediate layer-forming material, a high durability to repeated impact and a backspin rate-suppressing effect on shots with a number six iron similar to those in Example 1 were observed.

Japanese Patent Application No. 2019-230379 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a rubber core of at least one layer and an intermediate layer and outermost layer which encase the core, wherein the intermediate layer is formed of a thermoplastic resin composition having a flexural rigidity of from 400 to 500 MPa and a melt flow rate of 15 g/10 min or less, which thermoplastic resin composition includes a magnesium salt of an ethylenically unsaturated carboxylic acid copolymer in a content of from 50 to 100 wt % of the overall composition; the outermost layer is formed of a polyurethane resin composition which has a material hardness on the Shore D hardness scale of 55 or less; and the golf ball has a deflection when compressed under a final load of 1,275 N (130 kgf) from an initial load state of 98 N (10 kgf) of from 2.2 to 3.8 mm, wherein the thermoplastic resin composition includes a cyclic carbodiimide compound.

2. The golf ball of claim 1, wherein the thermoplastic resin composition has a melt flow rate of 12 g/10 min or less.

3. The golf ball of claim 1, wherein the thermoplastic resin composition has a flexural rigidity of at least 420 MPa.

4. The golf ball of claim 1, wherein the thermoplastic resin composition includes a sodium salt of an ethylenically unsaturated carboxylic acid copolymer having a flexural rigidity of from 380 to 450 MPa.

5. The golf ball of claim 1, wherein the thermoplastic resin composition includes an unneutralized ethylenically unsaturated carboxylic acid copolymer having a melt flow rate of from 30 to 500 g/10 min.

6. The golf ball of claim 1, wherein the thermoplastic resin composition includes a metal oxide selected from the group consisting of magnesium oxide, zinc oxide, titanium oxide and aluminum oxide.

7. The golf ball of claim 6, wherein the metal oxide is magnesium oxide.

* * * * *